US009045297B2

(12) United States Patent
Takamori

(10) Patent No.: US 9,045,297 B2
(45) Date of Patent: Jun. 2, 2015

(54) MEDIUM FEEDING APPARATUS

(71) Applicant: PFU Limited, Kahoku-shi, Ishikawa (JP)

(72) Inventor: Masaya Takamori, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 14/183,044

(22) Filed: Feb. 18, 2014

(65) Prior Publication Data

US 2014/0284877 A1 Sep. 25, 2014

(30) Foreign Application Priority Data

Mar. 25, 2013 (JP) ..... 2013-062084

(51) Int. Cl.

| | |
|---|---|
| ***B65H 7/06*** | (2006.01) |
| ***B65H 43/00*** | (2006.01) |
| ***B65H 7/20*** | (2006.01) |
| ***B65H 7/04*** | (2006.01) |
| ***B65H 43/04*** | (2006.01) |
| ***B65H 43/02*** | (2006.01) |

(52) U.S. Cl.

CPC .. *B65H 7/06* (2013.01); *B65H 7/20* (2013.01); *B65H 7/04* (2013.01); *B65H 43/04* (2013.01); *B65H 43/02* (2013.01); *B65H 2511/528* (2013.01); *B65H 2601/11* (2013.01)

(58) Field of Classification Search

CPC ..... B65H 2601/11; B65H 7/04; B65H 7/06; B65H 2511/528; B65H 43/00; B65H 43/02; B65H 43/04

USPC ..... 271/273; 399/21, 22

See application file for complete search history.

(56) References Cited

U.S. PATENT DOCUMENTS

| | | | | |
|---|---|---|---|---|
| 7,267,338 | B2 | 9/2007 | Kuwata et al. | |
| 7,269,361 | B2 | 9/2007 | Huss et al. | |
| 7,448,619 | B2 | 11/2008 | Kuwata et al. | |
| 8,196,925 | B2 * | 6/2012 | Richards et al. | 271/274 |
| 2010/0194026 | A1 * | 8/2010 | Iguchi | 271/3.15 |

FOREIGN PATENT DOCUMENTS

| | | |
|---|---|---|
| JP | 09-030662 | 2/1997 |
| JP | 09-090681 | 4/1997 |
| JP | 09-244321 | 9/1997 |
| JP | 10-048899 | 2/1998 |
| JP | 2003-302876 A | 10/2003 |
| JP | 2005-010575 A | 1/2005 |
| JP | 2006-121572 A | 5/2006 |
| JP | 2007-053532 A | 3/2007 |
| JP | 2010-117422 A | 5/2010 |

* cited by examiner

*Primary Examiner* — Patrick Cicchino

(74) *Attorney, Agent, or Firm* — McDermott Will & Emery LLP

(57) ABSTRACT

A medium feeding apparatus includes an opening/closing unit (a lock shaft, a lock arm, a hopper, a link member, and a rotating member) that performs an opening operation in a direction in which rollers of each of a separator and a conveyor coming into press contact with each other are separated from each other at the time of the occurrence of a conveyance error of a medium and performs a closing operation in a direction in which the rollers come into contact with each other after the recovery of the conveyance error. When an operator is present around the medium feeding apparatus, an error release operation control unit controls the opening/closing unit so that the opening/closing unit performs the opening operation and the closing operation at a relatively low speed as compared to when the operator is not present around the medium feeding apparatus.

3 Claims, 7 Drawing Sheets

MEDIUM FEEDING APPARATUS

CROSS-REFERENCE TO RELATED APPLICATION

This application is based upon and claims the benefit of priority from Japanese Patent Application No. 2013-062084, filed on Mar. 25, 2013, the entire contents of which are incorporated herein by reference.

BACKGROUND OF THE INVENTION

1. Field of the Invention

The present invention relates to a medium feeding apparatus.

2. Description of the Related Art

When a conveyance error, such as a jam or a double-feed, occurs in a medium feeding apparatus that separates and feeds media one by one from a plurality of stacked sheet-like media, recovery work for recovering the error is performed by an operator. In the recovery work, the operator opens a cover of a portion where the error occurs, removes a medium causing the error from the apparatus, closes the cover, and sets a medium again. In the past, techniques that automatically open a cover of a portion where an error occurs at the time of the occurrence of the conveyance error have been known to improve the efficiency of this recovery work (for example, see Japanese Laid-open Patent Publication No. 2003-302876 and Japanese Laid-open Patent Publication No. 2007-53532).

A medium feeding apparatus in the related art has room for the further ensuring of the safety of an operator in recovery work at the time of the occurrence of a conveyance error.

SUMMARY OF THE INVENTION

It is an object of the present invention to at least partially solve the problems in the conventional technology.

According to an aspect of the present invention, a medium feeding apparatus for feeding a medium in a conveying direction when the medium enters between members coming into press contact with each other on a conveying path. The medium feeding device includes an opening/closing unit that performs an opening operation in a direction in which the members are separated from each other at a time of an occurrence of a conveyance error of the medium and performs a closing operation in a direction in which the members come into contact with each other after a recovery of the conveyance error. When an operator is present around the medium feeding apparatus, the opening/closing unit performs the opening operation and the closing operation at a relatively low speed as compared to when the operator is not present around the medium feeding apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
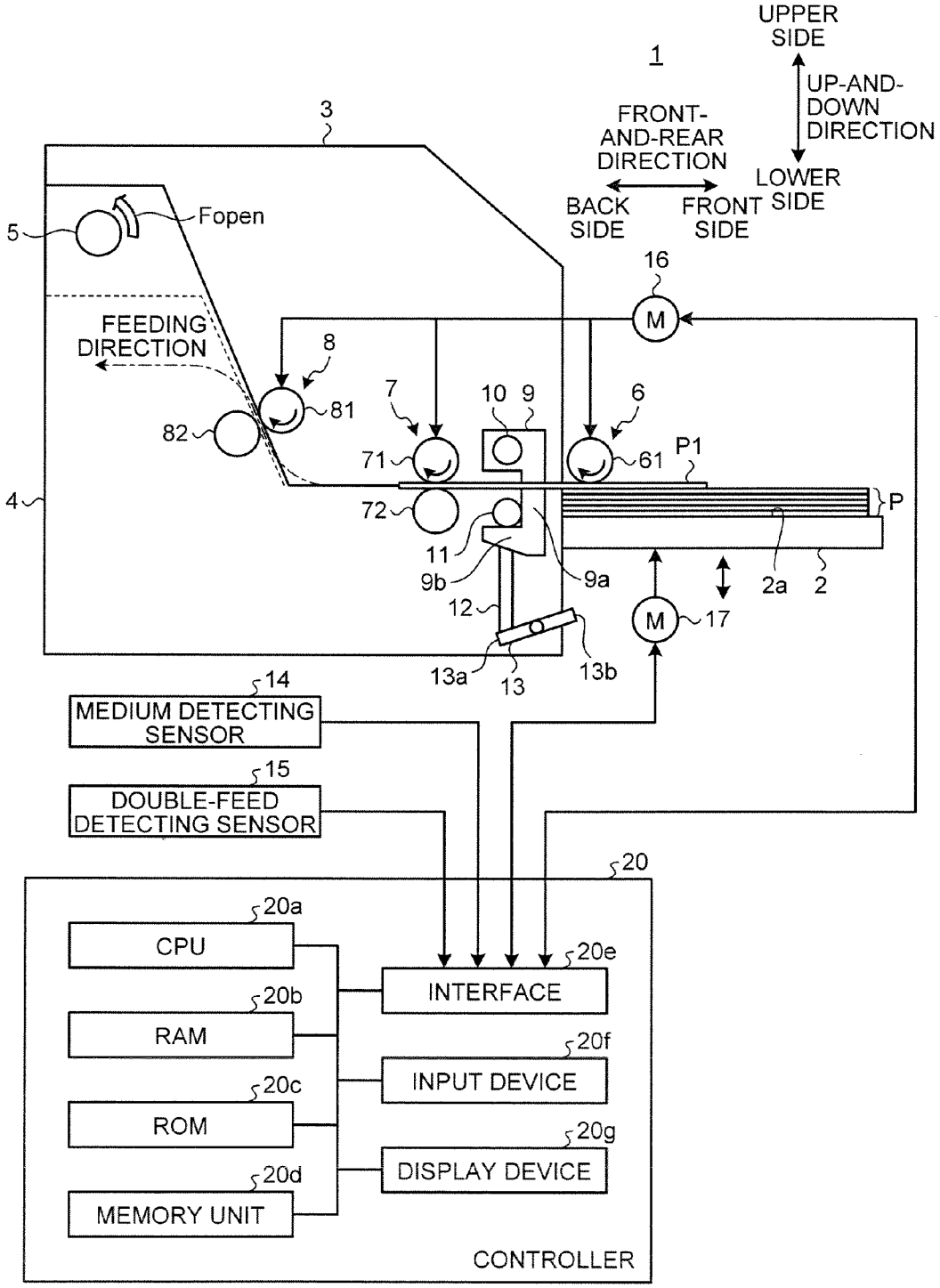
FIG. 1 is a diagram for explaining the hardware structure of a medium feeding apparatus according to a first embodiment of the invention.

A medium feeding apparatus according to embodiments of the invention will be explained below with reference to the drawings. Meanwhile, the same portions or corresponding portions are denoted by the same reference numerals, and the explanation thereof will not be repeated.

First Embodiment

A first embodiment will be explained with reference to FIGS. 1 to 4. First, the structure of a medium feeding apparatus according to the first embodiment will be explained with reference to FIGS. 1 and 2. FIG. 1 is a diagram for explaining the hardware structure of the medium feeding apparatus according to the first embodiment of the invention.

As shown in FIG. 1, a medium feeding apparatus 1 according to this embodiment is an apparatus that separates and feeds media P1 to be conveyed one by one from a plurality of media P stacked on a hopper 2. The medium feeding apparatus 1 is applied to an automatic document feeder (ADF) that is mounted on, for example, image readers, such as an image scanner, a copy machine, a facsimile, and a character recognition device, or an image forming apparatus, such as a printer. Media P and P1 include, for example, sheet-like objects to be read, such as a document and a business card, and sheet-like recording media, such as a print sheet and a sheet.

Meanwhile, in the following explanation, an up-and-down direction and a left-and-right direction in FIG. 1 are explained as an up-and-down direction and a front-and-rear direction of the medium feeding apparatus 1; the upper side, the lower side, the right side, and the left side in FIG. 1 are explained as the upper side, the lower side, the front side, and the back side of the medium feeding apparatus 1, respectively; and a vertical direction, that is, the up-and-down direction in FIG. 1 is explained as the "up-and-down direction". Further, a direction in which a medium P is fed by the medium feeding apparatus 1 is explained as a "feeding direction", a direction orthogonal to the feeding direction and a thickness direction of a medium P is explained as a "width direction", and the thickness direction of a medium P orthogonal to the feeding direction and the width direction is explained as a "height direction". In an example of FIG. 1, the front side of the medium feeding apparatus corresponds to the upstream side in the feeding direction and the back side of the medium feeding apparatus corresponds to the downstream side in the feeding direction.

The medium feeding apparatus 1 includes a rotating unit 3 and a fixed unit 4. The medium feeding apparatus 1 is placed so that the rotating unit 3 is positioned on the upper side in the up-and-down direction and the fixed unit 4 is positioned on the lower side in the up-and-down direction. The rotating unit 3 is rotatably supported by the fixed unit 4 on the back side in the front-and-rear direction. The rotating unit 3 can rotate relative to the fixed unit 4 about a rotating shaft 5, which is along the width direction, as the center of rotation in a predetermined rotation range.

Further, the medium feeding apparatus 1 includes the hopper 2, a feeder 6, a separator 7, a conveyor 8, and a controller 20.

Stacked media P are loaded on the hopper 2, and the hopper 2 can be moved up and down in the up-and-down direction (the thickness direction of the medium P) and includes a loading surface 2*a* that is formed in a substantially rectangular shape. A plurality of media P are stacked and loaded on the loading surface 2*a* of the hopper 2. Further, the hopper 2 is connected to a hopper driving motor 17 through a power transmission mechanism (not shown). When the hopper driving motor 17 is driven, the hopper 2 is moved up and down in the up-and-down direction according to the quantity of media P loaded on the loading surface 2*a*.

The feeder 6, the separator 7, and the conveyor 8 are provided at a predetermined interval on a conveying path along which a medium P1 is conveyed in the feeding direction. The feeder 6, the separator 7, and the conveyor 8 are positioned in this order from the upstream side toward the downstream side in the feeding direction.

The feeder 6 is a so-called upper picking type sheet feeding mechanism, feeds the media P loaded on the hopper 2, and includes a pick roller 61. The pick roller 61 feeds the uppermost medium P1 among the media P loaded on the hopper 2 and is made of, for example, a material having a large friction force such as foamed rubber so as to have a columnar shape. The pick roller 61 is installed so that the central axis of the pick roller 61 is substantially parallel to the width direction of the loading surface 2*a*, that is, is orthogonal to the feeding direction of the medium P while being along the loading surface 2*a*. Further, the central axis of the pick roller 61 is set on the upper surface of the hopper 2 (on the loading surface 2*a*), and the outer peripheral surface of the pick roller 61 is set at a position that has a predetermined interval interposed between the loading surface 2*a* of the hopper 2 and the outer peripheral surface of the pick roller in the height direction. The media P are loaded on the loading surface 2*a* so that the rear ends of the media P (upstream ends of the media in the feeding direction) are positioned on the upstream side of the pick roller 61 in the feeding direction. The hopper 2 approaches the pick roller 61 by being moved upward in the height direction, and is separated from the pick roller 61 by being moved downward.

Further, the pick roller 61 is connected to a roller driving motor 16 as a driving unit through a transmission gear or a belt (not shown), and is driven by a rotational driving force of the roller driving motor 16 so as to rotate about the central axis thereof as the center of rotation. The pick roller 61 is rotationally driven in a pick direction, that is, in a direction in which the outer peripheral surface of the pick roller 61 faces the separator 7 and the conveyor 8 on the loading surface 2*a* (a clockwise direction shown in FIG. 1 by an arrow).

The separator 7 separates the media P, which are fed from the hopper 2 by the feeder 6, one by one and includes a separating roller 71 and a braking roller 72. The separating roller 71 is made of, for example, a material having a large friction force such as foamed rubber so as to have a columnar shape. The separating roller 71 is provided on the downstream side of the pick roller 61 in the feeding direction so as to be substantially parallel to the pick roller 61. That is, the separating roller 71 is installed so that the central axis of the separating roller 71 is orthogonal to the feeding direction of the medium P while being along the loading surface 2*a*. Further, the central axis of the separating roller 71 is set on the upper surface of the hopper 2, and the outer peripheral surface of the separating roller 71 is set at a position that has a predetermined interval interposed between the loading surface 2*a* of the hopper 2 and the outer peripheral surface of the separating roller 71 in the height direction. The separating roller 71 is connected to the roller driving motor 16 through a transmission gear or a belt (not shown) for the purpose of making the apparatus compact, and is driven by a rotational driving force of the roller driving motor 16 so as to rotate about the central axis thereof as the center of rotation. That is, the pick roller 61 and the separating roller 71 use the roller driving motor 16 as a driving unit in common. However, the invention is not limited thereto and a driving motor may be separately provided as a driving unit that rotationally drives the separating roller 71. Just like the pick roller 61, the separating roller 71 is rotationally driven in a direction in which the outer peripheral surface of the separating roller 71 faces the conveyor 8 on the loading surface 2*a* (a clockwise direction shown in FIG. 1 by an arrow).

The braking roller 72 restricts the feeding of other media P except for a medium P1 that comes into direct contact with the pick roller 61. The braking roller 72 has substantially the same length as the length of the separating roller 71, and is formed in a columnar shape. Just like the separating roller 71, the braking roller 72 is provided so that the central axis of the braking roller 72 horizontally crosses the feeding direction of the medium P, that is, is along the width direction of the medium P. Further, the braking roller 72 is provided so as to be rotatable about the central axis thereof as a rotation axis. The braking roller 72 is provided so as to face the separating roller 71 and come into contact with the separating roller 71 in the height direction on the side of the loading surface 2*a*, and is pressed against (biased to) the separating roller 71 by a biasing unit (not shown). In this embodiment, a state in which the braking roller 72 comes into contact with the separating roller 71 is also expressed as "press contact" meaning a state in which the braking roller 72 is pressed against separating roller 71 at an arbitrary contact pressure. Since the braking roller 72 comes into press contact with the separating roller 71, the braking roller 72 is rotated following the rotation of the separating roller 71 in a direction in which the outer peripheral surface of the braking roller 72 faces the conveyor 8 on the contact surface between the separating roller 71 and the braking roller 72.

Meanwhile, a structure that stops and separates media P fed together with the uppermost medium P1 fed by the feeder 6 by rotationally driving the braking roller 72 in a direction opposite to the rotational driving direction of the separating roller 71 may be used instead of a structure that presses the braking roller 72 against the separating roller 71 by the biasing unit (not shown). Further, the braking roller 72 only has to be capable of functioning to apply a predetermined conveying load to a medium P entering a gap between the separating roller 71 and the braking roller 72 by coming into press contact with the separating roller 71. For example, the braking roller 72 may be substituted with a structure, such as a separating pad or a separating belt, other than a roller.

The conveyor 8 conveys the medium P1, which is fed by the feeder 6 and has passed through the separator 7, to each unit, which is provided on the further downstream side in the feeding direction, of an apparatus on which the medium feeding apparatus 1 is mounted. For example, when the medium feeding apparatus 1 is mounted on an image reader, an optical unit or the like as an image reading unit that reads images recorded on the medium P1 is provided on the downstream side of the conveyor 8 in the feeding direction. Accordingly, the images of the medium P1, which is conveyed in the image reader by the conveyor 8, are read by the optical unit.

Specifically, the conveyor 8 includes a conveying roller 81 that can be rotationally driven and a driven roller 82 that can be rotated following the conveying roller 81. The conveying roller 81 and the driven roller 82 have substantially the same length and are formed in a columnar shape. The conveying roller 81 and the driven roller 82 are provided so that the central axis of the conveying roller 81 and the driven roller 82 horizontally cross the feeding direction of the medium P1, that is, are along the width direction of the medium P1. Further, each of the conveying roller 81 and the driven roller 82 is provided so as to be rotatable about the central axis thereof as a rotation axis. The driven roller 82 is provided so as to face the conveying roller 81 and come into contact with the conveying roller 81, and is pressed against (biased to) the conveying roller 81 by a biasing unit (not shown). In this embodiment, a state in which the driven roller 82 comes into contact with the conveying roller 81 is also expressed as "press contact" meaning a state in which the driven roller 82 is pressed against the conveying roller 81 at an arbitrary contact pressure.

When the conveying roller 81 conveys the medium P1, the conveying roller 81 is rotationally driven in a direction in which the outer peripheral surface of the conveying roller 81 faces the inside of the apparatus, to which the medium feeding apparatus 1 is applied, from the separator 7 on the contact surface between the driven roller 82 and the conveying roller 81 (a clockwise direction shown in FIG. 1 by an arrow). Since the driven roller 82 comes into press contact with the conveying roller 81, the driven roller 82 is rotated following the rotation of the conveying roller 81 in a direction in which the outer peripheral surface of the driven roller 82 faces the inside of the apparatus from the separator 7 on the contact surface between the conveying roller 81 and the driven roller 82. Further, the conveyor 8 holds the medium P1 between the outer peripheral surface of the conveying roller 81 and the outer peripheral surface of the driven roller 82 by the pressing of the driven roller 82, and conveys the medium P1 by the rotational driving of the conveying roller 81 as explained above. Furthermore, the medium P1 is conveyed to each unit, which is provided in the apparatus to which the medium feeding apparatus 1 is applied, for example, the optical unit by being sequentially delivered between pairs of rollers that are formed of a plurality of conveying rollers (not shown) and a plurality of driven rollers (not shown) provided along the conveying path.

Meanwhile, the conveying roller 81 is also connected to the roller driving motor 16 through a transmission gear or a belt (not shown) for the purpose of making the apparatus compact. That is, the pick roller 61, the separating roller 71, and the conveying roller 81 use the roller driving motor 16 as a driving unit in common. However, the invention is not limited thereto and a driving motor may be separately provided as a driving unit that rotationally drives the conveying roller 81. Here, the rotational speed of the conveying roller 81 is adjusted by the transmission gear or the like, so that the conveying roller 81 is rotationally driven at a rotational speed relatively higher than the rotational speeds of the pick roller 61 and the separating roller 71. That is, the conveyor 8 can convey the medium P1, which is separated by the separator 7, at a speed higher than the speed of the medium P1 that is fed by the feeder 6. However, the conveyor 8 is not limited thereto, and may convey the medium P1 at the same speed as the speed of the medium P1 that is fed by the feeder 6.

The controller 20 controls the respective units of the medium feeding apparatus 1. Various sensors, such as a medium detecting sensor 14 that detects the presence or absence of the medium P1 on the conveying path and a double-feed detecting sensor 15 that detects the double-feed of the medium P1, the roller driving motor 16, and the hopper driving motor 17 are electrically connected to the controller 20. The controller 20 receives information from various sensors, such as the medium detecting sensor 14 and the double-feed detecting sensor 15. The controller 20 feeds the medium P1 in the feeding direction by controlling the roller driving motor 16 or the hopper driving motor 17 to drive each of the rollers of the feeder 6, the separator 7, and the conveyor 8 or the hopper 2.

As shown in FIG. 1, the controller 20 is physically a microcomputer including hardware, such as a central processing unit (CPU) 20*a*, a random access memory (RAM) 20*b*, a read only memory (ROM) 20*c*, a memory unit 20*d*, such as an electrically erasable and programmable read only memory (EEPROM) or a hard disk drive (HDD), an interface 20*e* that communicates with the respective units provided inside and outside the apparatus, an input device 20*f*, such as a switch, a keyboard, and a mouse, and a display device 20*g* such as a display. All or a part of the respective functions of the controller 20 to be explained below are realized by operating the interface 20*e*, the input device 20*f*, the display device 20*g*, and the like under the control of the CPU 20*a* and reading and writing data on the RAM 20*b*, the ROM 20*c*, and the memory unit 20*d* through the reading of a predetermined application program on the hardware, such as the CPU 20*a*, the RAM 20*b*, and the ROM 20*c*.

Meanwhile, the controller 20 may be built in the medium feeding apparatus 1 so as to be integrated with the medium feeding apparatus 1, or may be provided separately from the medium feeding apparatus 1 like, for example, a personal computer (PC) so as to be connected to the medium feeding apparatus 1 from the outside.

As shown in FIG. 1, the pick roller 61 of the feeder 6, the separating roller 71 of the separator 7, and the conveying roller 81 of the conveyor 8 are installed at the lower end of the rotating unit 3. The braking roller 72 of the separator 7 and the driven roller 82 of the conveyor 8 are installed at the upper end of the fixed unit 4. The hopper 2 is installed on the front side of the fixed unit 4. The rotating shaft 5 of the rotating unit 3 is disposed on the back side of the conveyor 8. The rotating unit 3 is rotated about the rotating shaft 5 as the center of rotation toward the fixed unit 4, and is fixed into the fixed unit 4 so that the braking roller 72 of the separator 7 comes into press contact with the separating roller 71 and the driven roller 82 of the conveyor 8 comes into press contact with the conveying roller 81, that is, the conveying path of the medium P1 is formed between the separating roller 71 and the braking roller 72 of the separator 7 and between the conveying roller 81 and the driven roller 82 of the conveyor 8.

The rotating unit 3 is provided with a lock arm 9. The lock arm 9 is supported by a rotating shaft 10 so as to be rotatable relative to the rotating unit 3. The lock arm 9 uses the rotating shaft 10 as the center of rotation, and includes an arm portion 9*a* that extends in a radial direction and a locking claw 9*b* that is bent at the tip of the arm portion 9*a* in a circumferential direction. Meanwhile, the fixed unit 4 is provided with a lock shaft 11. The lock shaft 11 is disposed substantially parallel to the rotating shaft 10 of the lock arm 9. The locking claw 9*b* of the lock arm 9 is adapted to be in a locking state in which the locking claw 9*b* comes into contact with the lock shaft 11 from below by being inserted below the lock shaft 11 by the rotation of the lock arm 9 about the rotating shaft 10.

As shown in FIG. 1, a force Fopen is biased to the rotating unit 3 in a direction in which the rotating unit 3 is rotated upward about the rotating shaft 5. Since the locking claw 9*b* of the lock arm 9 is locked to the lock shaft 11, the upward rotation of the rotating unit 3 caused by the force Fopen is restricted. Accordingly, the conveying path is maintained in the separator 7 and the conveyor 8.

When a conveying path needs to be opened such as when a conveyance error, such as a jam or double-feed, occurs on a conveying path in the related art, an operator needs to manually rotate a lock arm 9 to release the locking between a locking claw 9*b* and a lock shaft 11 and separate a rotating unit 3 from a fixed unit 4 to the upper side. Further, after recovery work is completed, the operator needs to manually fit the rotating unit 3 to the fixed unit 4 again and rotate the lock arm 9 to lock the locking claw 9*b* to the lock shaft 11. This work causes total time, which is taken for the recovery work, or the workload of an operator to increase.

In contrast, in this embodiment, the lock shaft 11 is automatically moved in the up-and-down direction while the lock arm 9 is locked to the lock shaft 11. Accordingly, the position of the rotating unit 3 relative to the fixed unit 4 is changed, so that the conveying path is opened and closed.

As shown in FIG. 1, a link member 12 is a member that linearly extends in the up-and-down direction, an upper end of the link member 12 is connected to the lock shaft 11, and a lower end of the link member 12 is connected to a rotating member 13. The rotating member 13 is supported so as to be rotatable about a rotation fulcrum that is substantially parallel to the axial direction of the lock shaft 11. The rotating member 13 linearly extends in a direction orthogonal to the axial direction of the rotation fulcrum, and one end (or end portion) 13*a* of the rotating member 13 is connected to the link member 12. Further, the other end (or end portion) 13*b* of the rotating member 13 is exposed to the front side of the fixed unit 4, and is disposed so as to be capable of coming into contact with the lower surface of the hopper 2. Furthermore, the rotating member 13 is disposed so that the end 13*b* is positioned above the end 13*a* while the rotating unit 3 is fitted to the fixed unit 4. That is, an angle that is formed between the link member 12 and the rotating member 13 at this time is an acute angle.

In this embodiment, the hopper 2 is adapted to be movable from a "normal position" at which the medium P1 is fed to the conveying path to a "release position" (see FIG. 4), which is present below the normal position, in the up-and-down direction. When the hopper 2 is moved to the release position, the end 13*b* of the rotating member 13 is pressed downward by the lower surface of the hopper 2. Accordingly, the rotating member 13 is rotated in a direction in which the end 13*a* is pushed upward (the clockwise direction in FIG. 1).

Figure 2:
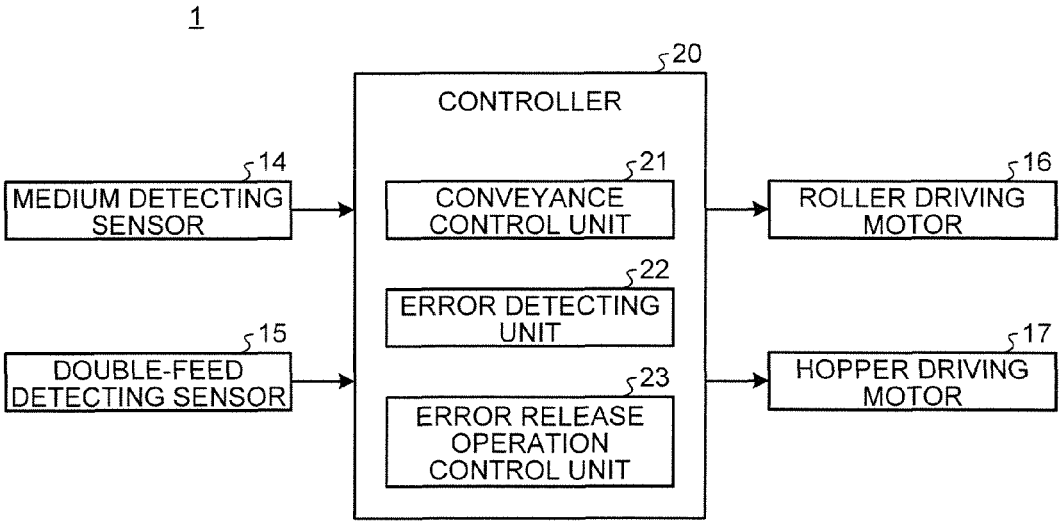
FIG. 2 is a functional block diagram of the medium feeding apparatus illustrated in FIG. 1.

FIG. 2 is a functional block diagram of the medium feeding apparatus shown in FIG. 1. The controller 20 of this embodiment can perform an operation for automatically opening the conveying path by moving the lock shaft 11 upward as explained above and can perform an operation for automatically closing the conveying path by moving the lock shaft 11 downward after the completion of the recovery work, according to the detection of a conveyance error. In regard to the functions, the controller 20 is adapted to achieve the respective functions of a conveyance control unit 21, an error detecting unit 22, and an error release operation control unit 23 as shown in FIG. 2.

The conveyance control unit 21 controls the conveyance of the medium P1 on the conveying path by controlling the rotation of each of the rollers of the feeder 6, the separator 7, and the conveyor 8 through the adjustment of the controlled variable of the roller driving motor 16. Further, when a conveyance error is detected by the error detecting unit 22, the conveyance control unit 21 stops an operation for conveying the medium P1 by stopping the drive of the roller driving motor 16.

The error detecting unit 22 detects the occurrence of a conveyance error on the conveying path. The error detecting unit 22 can detect a jam (paper jam) on the basis of the delay of the arrival time of the medium P1 or the deflection amount of the medium P1 that is detected by, for example, the medium detecting sensor 14. Further, the error detecting unit 22 can detect double-feed according to a measurement signal of the double-feed detecting sensor 15. When detecting a conveyance error, the error detecting unit 22 outputs an effect that a conveyance error is detected to the conveyance control unit 21 and the error release operation control unit 23.

The error release operation control unit 23 controls an operation for automatically opening/closing the rotating unit 3 according to the occurrence of a conveyance error. When a conveyance error occurs, recovery work for removing a medium P causing the conveyance error from the conveying path needs to be performed by an operator as explained above. The error release operation control unit 23 automatically performs an operation for opening/closing the rotating unit 3 that is performed before and after the recovery work. When a conveyance error is detected by the error detecting unit 22, the error release operation control unit 23 moves the hopper 2 downward by controlling the hopper driving motor 17 and moves the lock shaft 11 upward by applying an upward thrust to the lock shaft 11 through the rotating member 13 and the link member 12. Further, when the recovery work performed by the operator is completed and the removal of the medium P causing the conveyance error from the conveying path is detected, the error release operation control unit 23 moves the hopper 2 upward by controlling the hopper driving motor 17 again and allows the lock shaft 11 to move to the original lower position. In this embodiment, both the recovery work that is associated with the occurrence of a conveyance error and an operation for automatically opening/closing the rotating unit 3 that is performed before and after the recovery work are expressed as an "error release operation".

Further, the error release operation control unit 23 is adapted to be capable of ensuring the safety of an operator by performing the operation for automatically opening/closing the rotating unit 3 at a relatively low speed when the operator is present around the medium feeding apparatus 1.

Figure 3A:
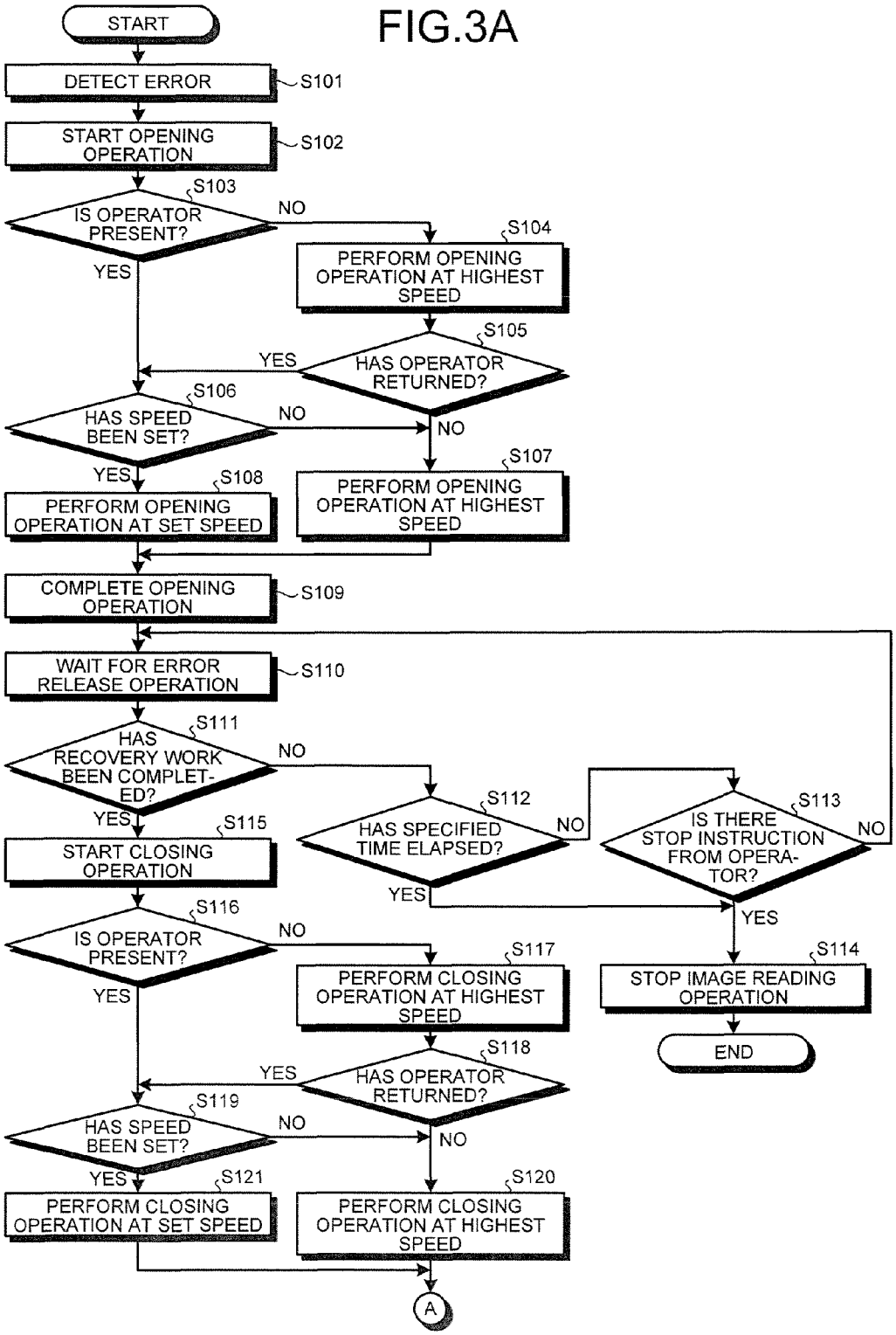
FIG. 3A is a flowchart for explaining error release processing when a conveyance error occurs in the medium feeding apparatus according to the first embodiment.
Figure 3B:
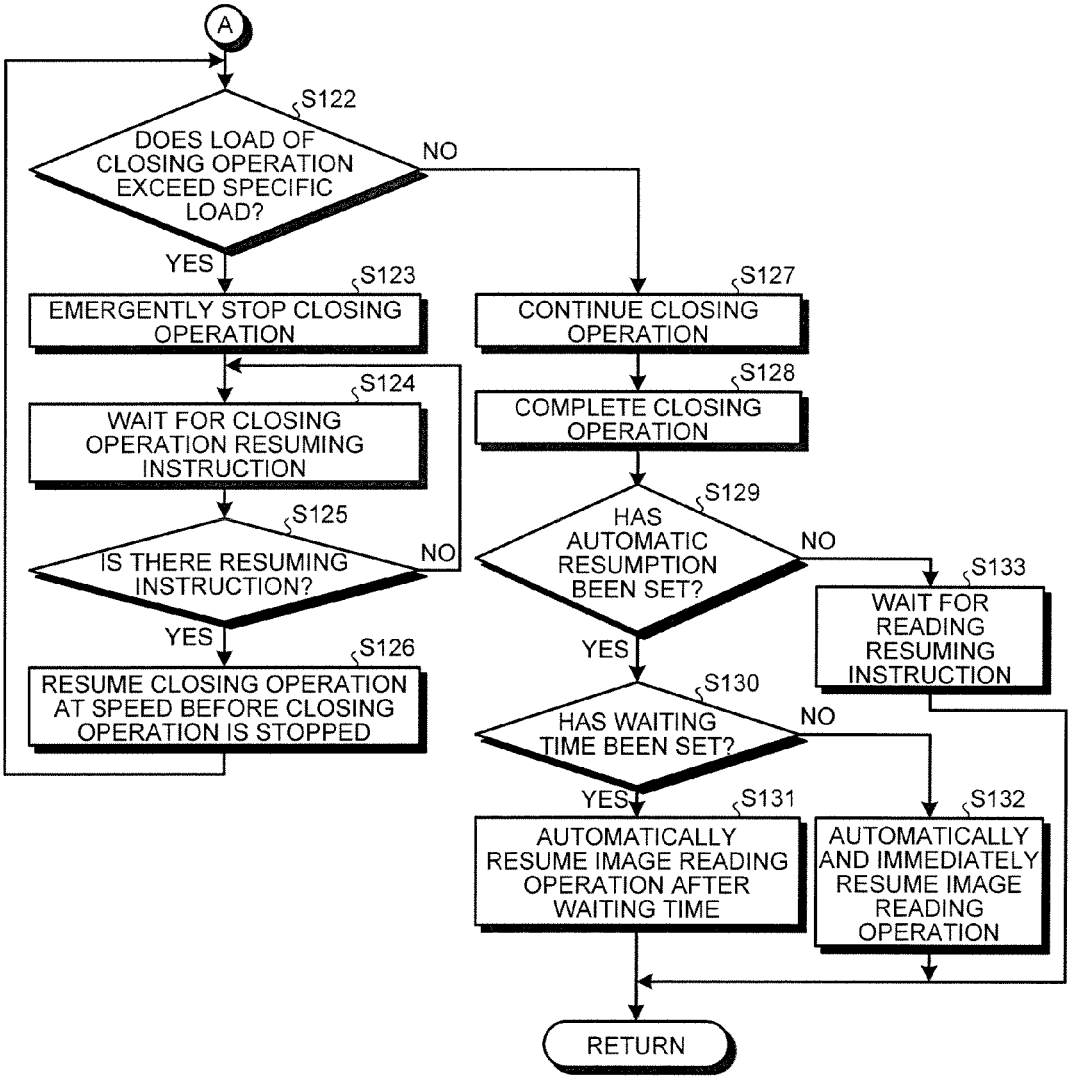
FIG. 3B is a flowchart for explaining error release processing when a conveyance error occurs in the medium feeding apparatus according to the first embodiment.
Figure 4:
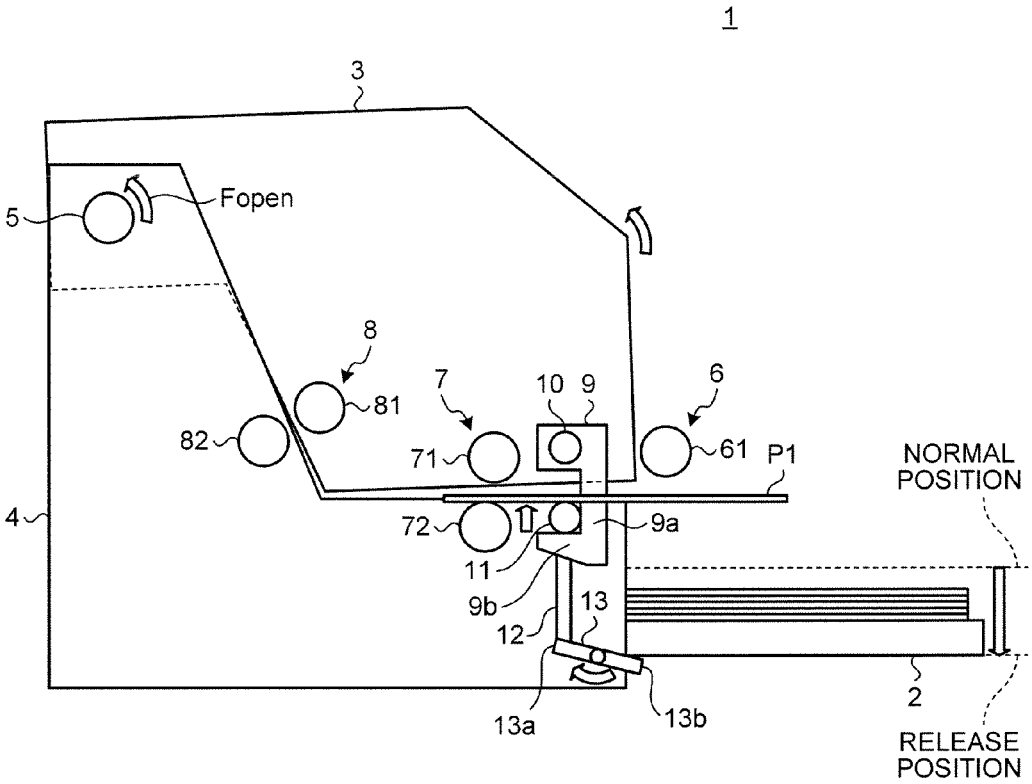
FIG. 4 is a schematic diagram for explaining a state in which a conveying path is opened by an error release operation.

Next, the operation of the medium feeding apparatus 1 according to the first embodiment will be explained with reference to FIGS. 3A, 3B, and 4. FIGS. 3A and 3B are flowcharts for explaining error release processing when a conveyance error occurs in the medium feeding apparatus according to the first embodiment. FIG. 4 is a schematic diagram for explaining a state in which a conveying path is opened by an error release operation.

In the flowcharts of FIGS. 3A and 3B (hereinafter, expressed together as "FIG. 3"), a structure in which the medium feeding apparatus 1 is applied to an image reader such as a scanner, that is, a situation in which a medium P is conveyed by the medium feeding apparatus 1 when an image reading operation for the medium P is performed by the image reader is exemplified and error release processing will be explained. The processing of the flowchart illustrated in FIG. 3 is performed by the controller 20 of the medium feeding apparatus 1 whenever an image reading operation for a medium P performed by the image reader is performed.

On the premise of the processing of the flowcharts illustrated in FIG. 3, the roller driving motor 16 is driven by the conveyance control unit 21 and each of the rollers of the feeder 6, the separator 7, and the conveyor 8 is rotated, so that an operation for conveying the medium P present on the hopper 2 to the image reader provided on the downstream side in the conveying direction is performed. During the operation for conveying the medium performed by the conveyance control unit 21, the error detecting unit 22 sequentially checks whether a conveyance error, such as double-feed or a jam, occurs on the conveying path.

When a conveyance error is detected by the error detecting unit 22 (Step S101), the conveying operation is stopped by the conveyance control unit 21 to make an operator perform recovery work from a state in which the conveyance error occurs and an "opening operation" is started by the error release operation control unit 23 (Step S102).

The "opening operation" started in Step S102 is an operation for moving the position of the hopper 2 downward in the up-and-down direction from a "normal position" at which a conveying operation for feeding the medium P to the conveying path is performed to a "release position", which is present below the normal position, as illustrated in FIG. 4. The error release operation control unit 23 moves the hopper 2 downward by driving the hopper driving motor 17. When the hopper 2 is moved downward to the release position by the opening operation, the end portion 13*b* of the rotating member 13 comes into contact with a lower surface of the hopper 2 and is pressed downward. Accordingly, the rotating member 13 is rotated about the rotation fulcrum as the center of rotation in a direction in which the end portion 13*b* is moved downward (the clockwise direction illustrated in FIG. 4 by an arrow). Since the end portion 13*a* of the rotating member 13 is moved upward by the rotation of the rotating member 13, the link member 12 connected to the end portion 13*a* is moved upward and the position of the lock shaft 11 connected to the link member 12 in the up-and-down direction is also moved upward.

At this time, the locking claw 9*b* of the lock arm 9 comes into contact with the lock shaft 11 from below and receives a force Fopen in a direction in which the rotating unit 3 is rotated upward about the rotating shaft 5 through the rotating shaft 10 and the arm portion 9*a*. For this reason, the lock arm 9 is moved upward with the upward movement of the lock shaft 11 in the up-and-down direction while following the lock shaft 11. Accordingly, the rotating unit 3 is rotated and moves upward by a distance at which the lock shaft 11 and the lock arm 9 are moved upward. As a result, a gap is formed between the rollers of each of the separator 7 and the conveyor 8 and the conveying path is opened.

Returning to FIG. 3, the error release operation control unit 23 checks whether an operator is present around the medium feeding apparatus 1 (Step S103). If the operator is not present around the medium feeding apparatus (No in Step S103), the opening operation is performed at the highest operation speed (Step S104). Meanwhile, if the operator is present around the medium feeding apparatus (Yes in Step S103), it is checked whether speed has been set for the opening operation (Step S106). The speed of the opening operation is set to speed relatively lower than the speed of the opening operation when an operator is not present around the medium feeding apparatus, in consideration of the safety of the operator. For example, the speed of the opening operation is set to a speed lower than the operation speed of Step S104. If speed has been set (Yes in Step S106), the opening operation is performed at the set speed (Step S108). If speed has not been set (No in Step S106), the opening operation is performed at the highest operation speed (Step S107). Meanwhile, if it is detected that the operator has returned to the vicinity of the medium feeding apparatus 1 while the opening operation is performed at the highest operation speed in Step S104 (Yes in Step S105), a process proceeds to Step S106 and it is checked whether speed has been set for the opening operation. If the operator does not return (No in Step S105), the opening operation is performed at the highest operation speed as it is.

When the opening operation, which is performed at the highest operation speed in Step S107 or at the set speed in the Step S108, is completed (Step S109), the operator of the image reader performs recovery work for removing a medium, which corresponds to a conveyance error, from the conveying path while the conveying path is opened by the opening operation. During the recovery work, the error release operation control unit 23 makes a waiting state for an error release operation (Step S110) and sequentially checks whether the recovery work of the operator has been completed (Step S111).

The completion of the recovery work can be determined on the basis of, for example, a detection signal of the medium detecting sensor 14 that is provided on the conveying path. Here, the medium detecting sensor 14 is a sensor that detects the presence or absence of a medium on the conveying path. For example, when a medium is present in the detection range of the medium detecting sensor 14, the detection signal of the medium detecting sensor 14 is in an ON state. Meanwhile, when a medium is not present in the detection range of the medium detecting sensor 14, the detection signal of the medium detecting sensor 14 is in an OFF state. Medium detecting sensors 14 are installed, for example, between the feeder 6, the separator 7, and the conveyor 8, respectively, that is, a plurality of medium detecting sensors 14 are installed on the conveying path. The controller 20 can specify the position of a medium on the conveying path with reference to the detection signals of the plurality of medium detecting sensors 14. Since the medium stays on the conveying path when a conveyance error occurs, the detection signal of at least one of the medium detecting sensors 14 is in an ON state. Meanwhile, when the recovery work has been completed and the medium has been removed from the conveying path, all of the detection signals of the medium detecting sensors 14 are in an OFF state. That is, it can be determined that the recovery work has been completed when the detection signals of the medium detecting sensors 14 are in an OFF state.

Meanwhile, a method other than a method using the medium detecting sensors 14 may be used as a method of determining the completion of the recovery work. For example, a method of determining the completion of the recovery work using the information of various sensors other than the medium detecting sensors 14 installed in the medium feeding apparatus 1 may be used, and a method of detecting the completion of the recovery work by the input of an instruction of an operator may be used.

If the recovery work is not completed (No in Step S111), a specified time has not elapsed from the waiting state (No in Step S112), and there is no stop instruction from the operator (No in Step S113), the process returns to Step S110 and the waiting state is continued. Meanwhile, if the specified time has elapsed from the waiting state (Yes in Step S112) or there is a stop instruction from the operator (Yes in Step S113), the image reading operation for a medium performed by the image reader is stopped by the controller 20 (Step S114) and this control flow is ended.

If the recovery work is completed (Yes in Step S111), a "closing operation" is subsequently started by the error release operation control unit 23 (Step S115).

The "closing operation" started in Step S115 is an operation reverse to the opening operation of Step S102. That is, the closing operation is an operation for returning the position of the hopper 2 in the up-and-down direction to the "normal position" by moving the position of the hopper 2 upward from the "release position" to which the hopper 2 has been moved by the opening operation. The error release operation control unit 23 moves the hopper 2 upward by driving the hopper driving motor 17. When the hopper 2 is moved upward from the release position by the closing operation, a downward pressing force applied to the end portion 13*b* of the rotating member 13 from the lower surface of the hopper 2 is removed. For this reason, the rotating member 13 is rotated in the direction in which the end portion 13*a* is moved downward (the counterclockwise direction in FIG. 4). The link member 12 connected to the end portion 13*a* of the rotating member 13 is moved downward by the rotation of the rotating member 13, and the position of the lock shaft 11, which is connected to the link member 12, in the up-and-down direction is also moved downward.

At this time, the positions of the lock arm 9 and the lock shaft 11 in the up-and-down direction are moved downward against the force Fopen. Accordingly, the rotating unit 3 is rotated and moved downward by a downward moving distance of the lock shaft 11 and the lock arm 9. As a result, the rollers of each of the separator 7 and the conveyor 8 come into press contact with each other and the conveying path is closed, so that a state returns to a state in which a medium can be conveyed to the conveying path. That is, a state can be changed into the state illustrated in FIG. 1 from the state illustrated in FIG. 4 by the closing operation.

Returning to FIG. 3, the error release operation control unit 23 checks whether an operator is present around the medium feeding apparatus 1 (Step S116). If an operator is not present around the medium feeding apparatus (No in Step S116), the closing operation is performed at the highest operation speed (Step S117). Meanwhile, if an operator is present around the medium feeding apparatus (Yes in Step S116), it is checked whether speed has been set for the closing operation (Step S119). The speed of the closing operation is set to a relatively low speed in consideration of the safety of an operator. For example, the speed of the closing operation is set to a speed lower than the operation speed of Step S117. If speed has been set (Yes in Step S119), the closing operation is performed at the set speed (Step S121). If speed has not been set (No in Step S119), the closing operation is performed at the highest operation speed (Step S120). Meanwhile, if it is detected that an operator has returned to the vicinity of the medium feeding apparatus 1 while the opening/closing operation is performed at the highest operation speed in Step S117 (Yes in Step S118), the process proceeds to Step S119 and it is checked whether speed has been set for the closing operation. If speed has not been set for the closing operation (No in Step S118), the closing operation is performed at the highest operation speed as it is.

In addition, while the closing operation is performed, it is sequentially checked whether a load of the closing operation exceeds a specific load (Step S122). If the load of the closing operation exceeds the specific load (Yes in Step S122), it is considered a situation in which a foreign material such as a finger of an operator is present between the rotating unit 3 and the fixed unit 4 during the closing operation. Accordingly, the closing operation is emergently stopped (Step S123), and a waiting state for a closing operation resuming instruction is made (Step S124) while there is no resuming instruction of the operator (No in Step S125). If there is a closing operation resuming instruction performed by an operator (Yes in Step S125), the closing operation is resumed at a speed immediately before the closing operation is emergently stopped (Step S126), the process returns to Step S122, and a load during the closing operation is monitored.

If the load of the closing operation does not exceed the specific load (No in Step S122), the closing operation is continued (Step S127). If the closing operation is completed (Step S128), it is checked whether automatic resumption has been set (Step S129). If the automatic resumption has been set (Yes in Step S129) and a waiting time has been set (Yes in Step S130), the image reading operation is automatically resumed after the waiting time has elapsed (Step S131) and this control flow is ended. If a waiting time has not been set (No in Step S130), the image reading operation is automatically resumed immediately (Step S132) and this control flow is ended. Meanwhile, if automatic resumption has not been set (No in Step S129), a waiting state for a reading resuming instruction input by an operator is made (Step S133) and this control flow is ended.

Next, the advantageous effects of the medium feeding apparatus 1 according to the first embodiment will be explained.

The medium feeding apparatus 1 according to the first embodiment includes an opening/closing unit that performs an opening operation in a direction in which the rollers of each of the separator 7 and the conveyor 8 coming into press contact with each other are separated from each other at the time of the occurrence of a conveyance error of the medium P1 and performs a closing operation in a direction in which the rollers come into contact with each other after the recovery of the conveyance error. In this embodiment, a component that includes the lock shaft 11 moving in the up-and-down direction, the lock arm 9 opening/closing the rotating unit 3 while interlocking with the operation of the lock shaft 11, the hopper 2, and the link member 12 and the rotating member 13 transmitting a thrust from the hopper 2 to the lock shaft 11 functions as the opening/closing unit. The operation of the opening/closing unit is controlled by the error release operation control unit 23 of the controller 20. Further, when an operator is present around the medium feeding apparatus 1, the error release operation control unit 23 controls the opening/closing unit so that the opening/closing unit performs the opening operation and the closing operation at a relatively low speed as compared to when an operator is not present around the medium feeding apparatus 1.

According to this structure, if an operator is present around the medium feeding apparatus when an opening/closing operation associated with a conveyance error is to be performed, the opening/closing operation is performed at a low speed. Accordingly, the operator can cope with the opening/closing operation with a sufficient spare time, so that it is possible to suitably ensure the safety of the operator. Further, since the opening/closing operation before and after the recovery work is automatically performed by the opening/closing unit when a conveyance error occurs, it is possible to reduce the work time and work load of the error release operation and to improve work efficiency.

Furthermore, when an operator is not present around the medium feeding apparatus and the safety of the operator does not need to be considered, the opening/closing operation is performed at a high speed. Accordingly, it is possible to reduce the work time of the error release operation and to further improve work efficiency.

Second Embodiment

Figure 5A:
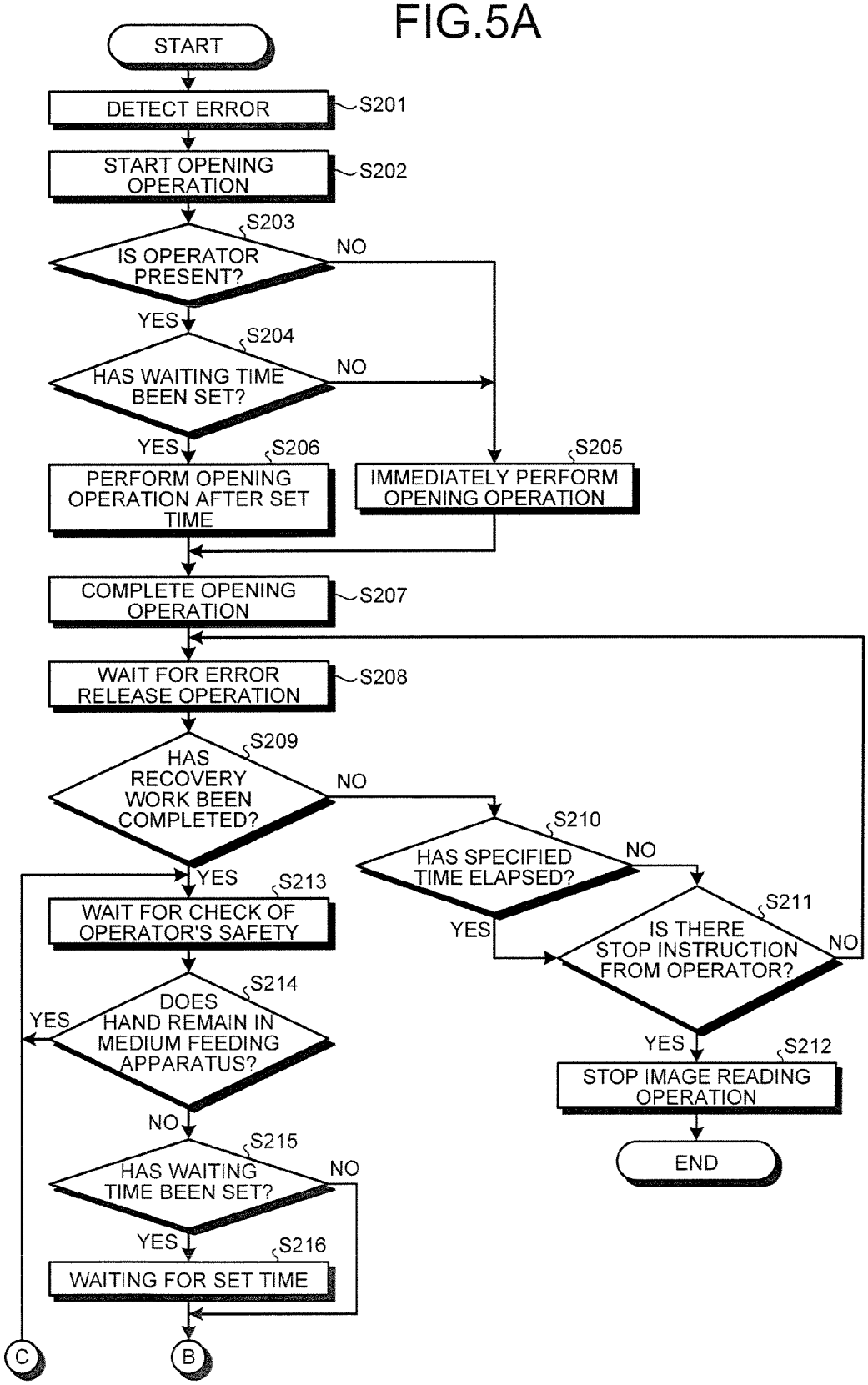
FIG. 5A is a flowchart for explaining error release processing when a conveyance error occurs in a medium feeding apparatus according to a second embodiment.
Figure 5B:
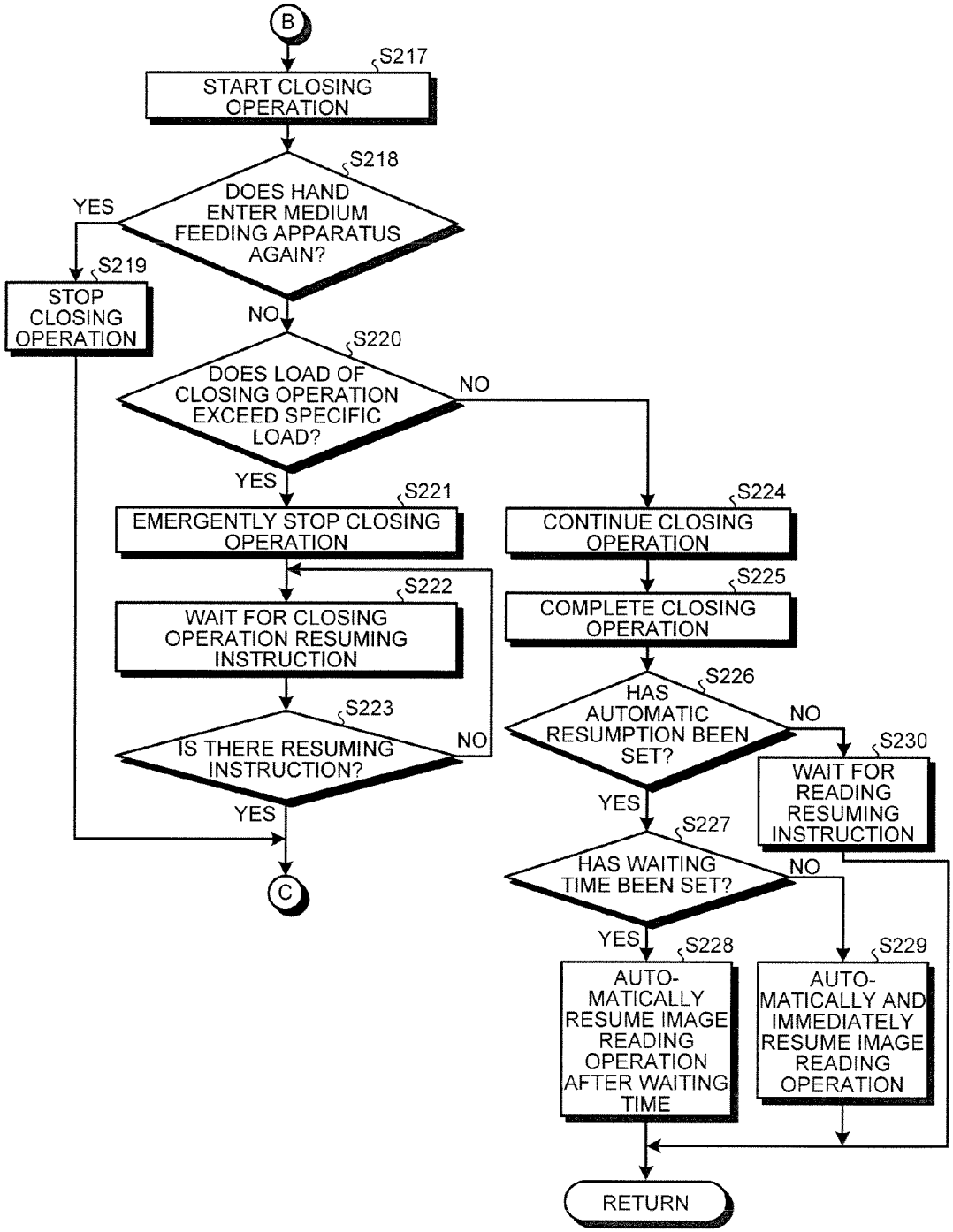
FIG. 5B is a flowchart for explaining error release processing when a conveyance error occurs in the medium feeding apparatus according to the second embodiment.

Next, a second embodiment of the invention will be explained with reference to FIGS. 5A and 5B. FIGS. 5A and 5B (hereinafter, expressed together as "FIG. 5") are flowcharts for explaining error release processing when a conveyance error occurs in a medium feeding apparatus according to the second embodiment.

The second embodiment is different from the first embodiment in that the error release operation control unit 23 of the controller 20 controls an opening/closing unit so that the opening/closing unit performs the opening operation and the closing operation after the elapse of a predetermined waiting time when an operator is present around the medium feeding apparatus.

The operation of this embodiment will be explained with reference to the flowchart of FIG. 5.

When a conveyance error is detected by the error detecting unit 22 (Step S201), a conveying operation is stopped by the conveyance control unit 21 to make an operator perform recovery work from a state in which the conveyance error occurs and an "opening operation" is started by the error release operation control unit 23 (Step S202). Further, if the operator is present around the medium feeding apparatus 1 (Yes in Step S203) and a waiting time has been set (Yes in Step S204), an opening operation is performed after the set waiting time has elapsed (Step S206). Meanwhile, for example, the time of the detection of the error of Step S201 can be set as a start trigger that indicates the elapse of the waiting time. On the other hand, if the operator is not present around the medium feeding apparatus 1 (No in Step S203) or if a waiting time has not been set (No in Step S204), the opening operation is immediately performed (Step S205).

When the opening operation, which is immediately performed in Step S205 or is performed after the elapse of the set time in Step S206, is completed (Step S207), the operator of the image reader performs recovery work for removing a medium, which corresponds to a conveyance error, from the conveying path while the conveying path is opened by the opening operation. During the recovery work, the error release operation control unit 23 makes a waiting state for an error release operation (Step S208) and sequentially checks whether the recovery work of the operator has been completed (Step S209).

If the recovery work is not completed (No in Step S209), a specified time has not elapsed from the waiting state (No in Step S210), and there is no stop instruction from the operator (No in Step S211), the process returns to Step S208 and the waiting state is continued. Meanwhile, if the specified time has elapsed from the waiting state (Yes in Step S210) or there is a stop instruction from the operator (Yes in Step S211), the image reading operation for a medium performed by the image reader is stopped by the controller 20 (Step S212) and this control flow is ended.

If the recovery work is completed (Yes in Step S209), an operator's safety check waiting state is made (Step S213) and the waiting state of Step S213 is continued while the hand of the operator remains in the medium feeding apparatus (Yes in Step S214). If it is detected that the hand of the operator is not present in the medium feeding apparatus (No in Step S214) and a waiting time has been set (Yes in Step S215), the error release operation control unit 23 subsequently starts a "closing operation" (Step S217) after waiting for the set waiting time (Step S216). Meanwhile, for example, the time of the completion of the recovery work of Step S209 can be set as a start trigger that indicates the elapse of the waiting time. On the other hand, if the waiting time has not been set (No in Step S215), the closing operation is immediately performed (Step S217).

Here, if it is detected that the hand of the operator enters the medium feeding apparatus again during the closing operation (Yes in Step S218), the closing operation is stopped (Step S219), the process returns to Step S213, and the operator's safety check waiting state is made again. If it is not detected that the hand of the operator enters the medium feeding apparatus again during the closing operation (No in Step S218), the process proceeds to Step S220.

Moreover, during the closing operation, it is sequentially checked whether a load of the closing operation exceeds a specific load (Step S220). If the load of the closing operation exceeds the specific load (Yes in Step S220), the closing operation is emergently stopped (Step S221), and a waiting state for a closing operation resuming instruction is made (Step S222) while there is no resuming instruction of the operator (No in Step S223). If there is a closing operation resuming instruction performed by the operator (Yes in Step S223), the process returns to Step S213, and the operator's safety check waiting state is made again. If the load of the closing operation does not exceed the specific load (No in Step S220), the closing operation is continued (Step S224). Meanwhile, since the contents of the respective processing steps of Steps S224 to S230 are the same as those of Steps S127 to S133 of the first embodiment, the explanation thereof will not be repeated.

As explained above, in the medium feeding apparatus 1 according to the second embodiment, the error release operation control unit 23 of the controller 20 controls the opening/closing unit so that the opening/closing unit performs the opening operation and the closing operation after the elapse of a predetermined waiting time when an operator is present around the medium feeding apparatus.

According to this structure, if an operator is present around the medium feeding apparatus when an opening/closing operation associated with a conveyance error is to be performed, the opening/closing operation is performed after the elapse of a predetermined waiting time. Accordingly, it is possible to give a sufficient spare time to the operator before the opening/closing operation is performed, so that it is possible to suitably ensure the safety of the operator.

Further, in the medium feeding apparatus 1 according to the second embodiment, the error release operation control unit 23 controls the opening/closing unit so that the opening/closing unit immediately performs the opening operation and the closing operation when an operator is not present around the medium feeding apparatus.

According to this structure, since the opening/closing operation is performed immediately when an operator is not present around the medium feeding apparatus and the safety of the operator does not need to be considered, it is possible to reduce the work time of the error release operation and to further improve work efficiency.

The embodiments of the invention have been explained above, but the embodiments are merely illustrative and do not limit the scope of the invention. The embodiments may be embodied in various other forms, and may have various kinds of omission, substitution, and change without departing from the gist of the invention. The embodiments or modifications thereof are included in the inventions disclosed in the claims and the equivalent scope thereof so as to be included in the scope or gist of the invention.

A structure in which the separating roller 71 and the conveying roller 81 driven in the conveying direction are disposed in the rotating unit 3 and the braking roller 72 and the driven roller 82 are disposed in the fixed unit 4 has been exemplified in the embodiments, but these rollers may be disposed on the contrary. That is, the separating roller 71 and the conveying roller 81 may be disposed in the fixed unit 4 and the braking roller 72 and the driven roller 82 may be disposed in the rotating unit 3. Further, the separating roller 71 and the conveying roller 81 may be separately disposed in the rotating unit 3 and the fixed unit 4.

In the embodiments, a structure, which moves the lock shaft 11 in the up-and-down direction according to the movement of the hopper 2, has been exemplified as the opening/closing unit that automatically performs the opening/closing operation of the rotating unit 3 before and after the recovery work at the time of the occurrence of a conveyance error of the medium P1. However, other structures may be applied as long as being capable of exhibiting the function of the opening/closing unit.

According to the medium feeding apparatus of the embodiments of the invention, it is possible to suitably ensure the safety of an operator in recovery work at the time of the occurrence of a conveyance error by performing an opening/closing operation at a low speed or performing an opening/closing operation after the elapse of waiting time if an operator is present around the medium feeding apparatus when an opening/closing operation associated with a conveyance error is to be performed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A medium feeding apparatus for feeding a medium in a conveying direction when the medium enters between members coming into press contact with each other on a conveying path, the medium feeding apparatus comprising:

an opening/closing unit that performs an opening operation in a direction in which the members are separated from each other at a time of an occurrence of a conveyance error of the medium and performs a closing operation in a direction in which the members come into contact with each other after a recovery of the conveyance error; and a controller configured to:

determine whether an operator is present around the medium feeding apparatus;

perform the opening operation and the closing operation by the opening/closing unit at a first operation speed when the operator is not present around the medium feeding apparatus; and perform the opening operation and the closing operation by the opening/closing unit at a second operation speed that is relatively lower than the first operation speed when the operator is present around the medium feeding apparatus.

2. A medium feeding apparatus for feeding a medium in a conveying direction when the medium enters between members coming into press contact with each other on a conveying path, the medium feeding apparatus comprising:

an opening/closing unit that performs an opening operation in a direction in which the members are separated from each other at a time of an occurrence of a conveyance error of the medium and performs a closing operation in a direction in which the members come into contact with each other after a recovery of the conveyance error;

an error detector configured to detect the conveyance error of the medium in the conveying path; and a controller configured to:

determine whether an operator is present around the medium feeding apparatus;

perform the opening operation and the closing operation by the opening/closing unit in response to the detection of the conveyance error by the error detector when the operator is not present around the medium feeding apparatus; and perform the opening operation and the closing operation by the opening/closing unit after an elapse of a predetermined waiting time triggered based on the detection of the conveyance error by the error detector when the operator is present around the medium feeding apparatus.

3. A medium feeding apparatus for feeding a medium in a conveying direction, comprising:

a fixed unit having first conveying members;

a rotating unit rotatably supported by the fixed unit and having second conveying members coming into press contact with the first conveying members in order to convey the medium on a conveying path;

an error detector configured to detect a conveyance error of the medium in the conveying path;

an opening/closing unit that performs an opening operation in a direction in which the first and second members are separated from each other based on the detection of the conveyance error of the medium by the error detector; and a controller configured to:

select one of a first operation mode and a second operation mode other than the first operation mode in order to perform the opening operation in cooperation with the opening/closing unit;

perform the opening operation by the opening/closing unit at a first operation speed when the first operation mode is selected; and perform the opening operation by the opening/closing unit at a second operation speed that is relatively lower than the first operation speed when the second operation mode is selected.

* * * * *